United States Patent [19]

Tatton et al.

[11] 4,050,400

[45] Sept. 27, 1977

[54] MARINE NAVIGATION INSTRUMENT

[76] Inventors: Nelson Tatton, Palgrove, Ontario; James Tatton, 74 Gunn Street, Barrie, Ontario, both of Canada

[21] Appl. No.: 687,367

[22] Filed: May 17, 1976

[51] Int. Cl.[2] ..... B63B 45/00

[52] U.S. Cl. ..... 116/26; 116/DIG. 43

[58] Field of Search ..... 116/19, 18, 26, 124 D, 116/DIG. 43, 133, 129 T; 9/9; 40/34, 70; 35/74; 240/7.1 R

[56] References Cited

U.S. PATENT DOCUMENTS

| | | | |
|---|---|---|---|
| 2,633,818 | 4/1953 | Garrett | 116/26 |
| 3,205,708 | 9/1965 | Andresen, Jr. | 116/DIG. 43 |
| 3,627,200 | 12/1971 | Sadler | 116/133 |
| 3,777,699 | 11/1973 | Pfleger | 116/133 |

*Primary Examiner*—Richard C. Queisser
*Assistant Examiner*—Daniel M. Yasich

[57] ABSTRACT

A navigational instrument known as a buoy reminder which includes a base adapted to support an indicator for lateral reciprocal movement thereon. The reminder has two depictions of nun and can buoys which are in a specific relation. The reminder also comprises a means to exhibit a nun buoy at a first site when it is in a certain position and a can buoy at a second site when it is in a second position.

9 Claims, 3 Drawing Figures

MARINE NAVIGATION INSTRUMENT

FIELD OF THE INVENTION

This invention relates to improvements in navigational instruments used in boating and in particular to improvements in such instruments known as Buoy Reminders.

BACKGROUND TO THE INVENTION

To assist the boating enthusiast navigate for example, rivers, two varieties of buoys have been utilized and placed strategically therein to mark hazards and designate the safe channel through which the boat may be safely guided, a peaked or nun buoy usually, red, and a flat top or can buoy, usually black. If the buoys in the channel are coloured as above, the rule of navigation for passing through the marked channel is simply keep the red buoy on your right when travelling upstream.

Wherever, for example, the two buoys are provided in a line at right angles to the direction of travel, the navigator knows to pass between them. However, where only one buoy marks the channel, unless certain of the rule, the boater is faced with the dilemma of whether to pass to the right or to the left of the buoy. Further complicating his decision is the requirement that he know whether he is travelling up or downstream.

It is, therefore as a result of this dilemma, that buoy reminders have been constructed. However, such indicators as for example, that disclosed in U.S. Pat. No. 2,633,818, have not been highly satisfactorily constructed. They are awkward to operate, difficult to manipulate and they are costly.

It is, therefore, an object of this invention to provide an improved buoy reminder having fewer moving parts than the prior art structures and as a result, longer life expectancy.

It is a further object of this invention to provide a buoy indicator which is simpler to operate and structurally more sturdy.

Still further objects and advantages of the invention will be observed by those skilled in the art from the following summary of invention and more detailed description thereof.

SUMMARY OF THE INVENTION

According to one important aspect of the invention, a buoy reminder includes a reciprocally moveable indicator depicting two pairs of nun and can buoys in specific relation which at a quick glance provides the navigator with the necessary information for him to navigate the boat safely through any charted water channel.

According to another aspect of the invention, simple rotation of a component of the buoy reminder of less than 180°, for example 90° and preferably less than 25°, may move such indicator from a first to a second position where at said first position, a nun and can buoy are displayed at first and second sites and at said second position, a can and nun buoy, respectively.

According to another aspect of the invention, such indicator may be reciprocally cammed by such rotational movement from said first to said second position.

According to another important aspect of the invention, an improved buoy indicator is provided of a much sturdier construction and of a long life expectancy.

BRIEF DESCRIPTION OF THE DRAWINGS

The invention will not be illustrated with reference to the following drawings in which like numerals refer to like parts, and in which.

DETAILED DESCRIPTION OF THE DRAWINGS

Figure 1:
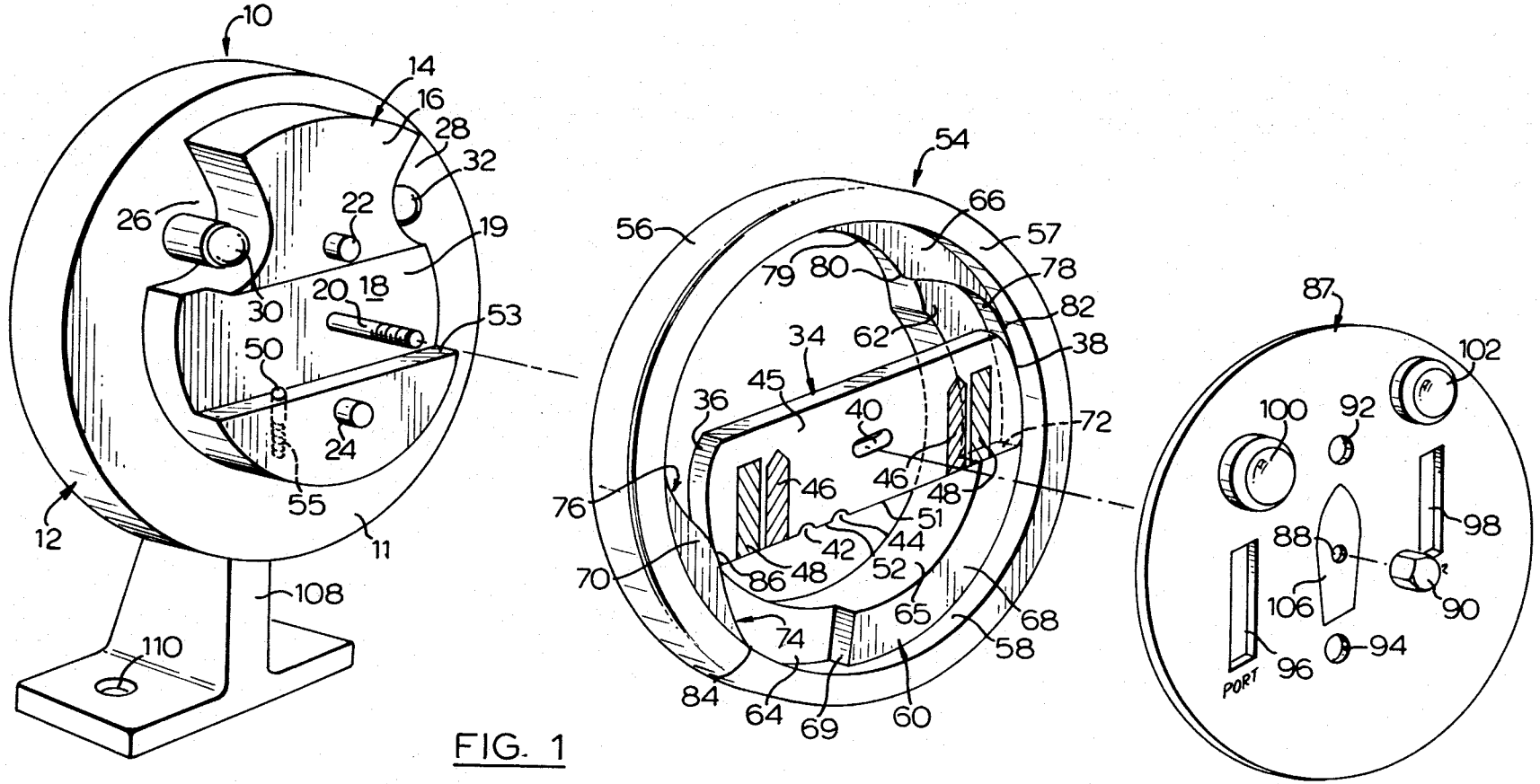
FIG. 1 is an exploded perspective view of a buoy indicator according to a preferred embodiment of the invention.

With reference to FIG. 1, a buoy reminder, generally depicted as 10, is provided having backing or mounting member 12, having face 11 and stepped concentric cylinder 14 having face 16, portions of which have been removed to form longitudinal channel 18 and light recesses 26 and 28 respectively both to mount lights 30 and 32 therein and to guide light from said lights into said channel. Lights 30 and 32 are wired, not shown, to for example a battery also not shown. Extending outwardly from face 16 are outwardly projecting stem 20, and smaller stems 22 and 24 vertically above and below stem 20.

Slide indicator 34, provided to ride longitudinally in channel 18, is longer than said channel and has curved ends 36 and 38 for purposes hereinafter described. Elongated longitudinal slot 40 is situated at the centre thereof through which stem 20 is inserted when indicator 34 is positioned in channel 18. Two notches 42 and 44, separated a predetermined distance, are cut into the bottom longitudinal edge 51 of indicator 34 for the purposes hereinafter described. Depictions of buoys appear on the front face 45 of indicator 34, nun buoys depicted at 46 and can buoys at 48. Indicator 34 is adapted to be secured for longitudinal reciprocal movement in channel 18 by a spring-loaded projection 50 extending through upwardly facing ledge 53 of the channel 18, to be received by notches 42 and 44 as indicator 34 slides in said channel, and by stem 20 secured through slot 40.

Figure 2:
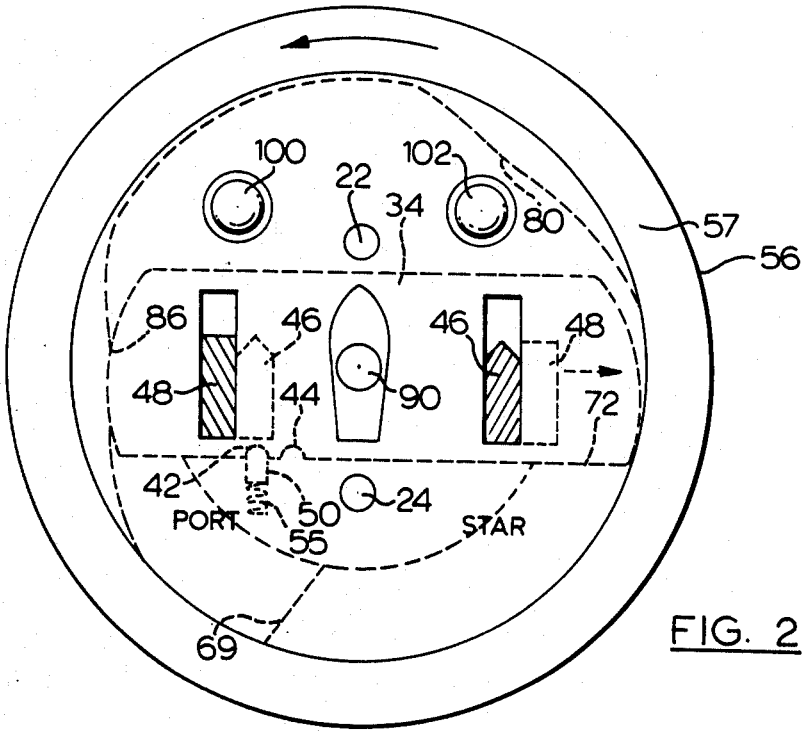
FIGS. 2 and 3 are front views of the indicator provided in FIG. 1.
Figure 3:
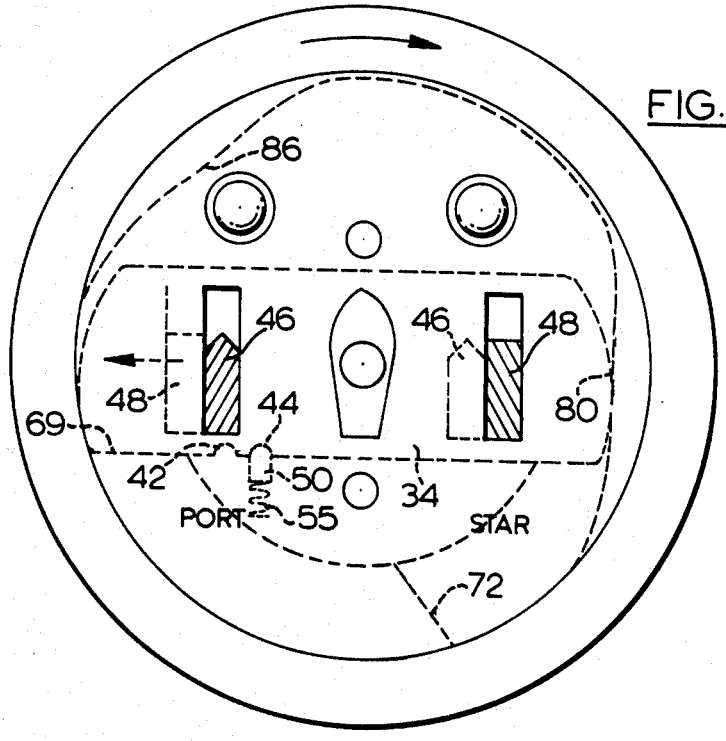

The disposition of the recesses 26 and 28, the notches 42 and 44 and the buoys 46 and 48 are such that when spring-loaded projection extends into notch 42, buoy 48 is vertically aligned with recess 26 and buoy 46 is vertically aligned with recess 28. (See FIG. 2.) When indicator 34 is moved longitudinally to the left, projection 50 disengages from notch 42 so as to ride on portion 52 of bottom longitudinal edge 51, against the vertical action of the compression spring 55 until projection 50 under the compression of the spring, is moved into vertical engagement with notch 44, whereupon projection 50 is urged into notch 44. In this case buoy 46 is vertically aligned with recess 26 and buoy 48 with recess 28. (See FIG. 3.)

Adapted to seat around stepped concentric cylinder 14 and on face 11, frame 54 is provided to cam indicator 34 longitudinally whenever frame 54 is rotated about cylinder 14. Frame 54 comprises peripheral circular ring 56, having frontal face 57. Extending around a portion of the radial inner surface 58 of ring 56, and recessed relative to face 57, is radially tapered arcuate shoulder formation 60. Shoulder formation 60 has two intermediate portions thereof removed to a predetermined depth to form coplanar recessed ledges 62 and 64 and coplanar raised step portions 66, 68 and 70, for the purposes hereinafter described. Walls 69 and 72 define the circumferential, and wall 65 the inner, radial, extent of step 68, tapered and curved walls 74 and 76 define the inner radial extent of step 70, and tapered and curved walls 78 and 79 define the inner radial extent of step 66.

To assemble buoy reminder 10, frame 54 is disposed around cylinder 14 and abuts face 11. As a result, channel backwall 19 and ledges 62 and 64 are coplanar. Indicator 34 is then secured in channel 18 on stem 20 to abut against backwall 19 and ledges 62 and 64, ensuring that projection 50 is disposed in either of notches 42 or 44 or against under surface 52. A portion of each of curved longitudinal edges 36 and 38 of indicator 34 preferably abuts curved walls 74 and 78 at all times. It is, of course, apparent that the distance between curved walls 74 and 78 must be sufficient to permit the length of the indicator to be accommodated therebetween at all times.

In operation, as frame 54 is rotated clockwise, generally radially outwardly tapered wall 78, considered from position 80 to 82 on the periphery of ledge 66, bears against curved wall 38 of indicator 34 and forces indicator 34 to the left. Wall 74, which tapers generally radially inwardly from point 84 to 86 at the inner periphery of ledge 70, accommodates the indicator as it moves left until wall 69 abuts against the lower edge 51 of indicator 34 thereby positioning the indicator to align buoy 46 with recess 26, and buoy 48, with recess 28, and to secure projection 50 in notch 44. (See FIG. 3.) When the frame is rotated in the reverse direction projection 50 is urged out of notch 44, indicator 34 is cammed longitudinally to the right until wall 72 of step 68 abuts edge 51 thereby vertically aligning buoy 46 with recess 28, and buoy 48, with recess 26, and securing projection 50 in notch 42. (See FIG. 2.)

Face plate 87 is secured to member 12 by means of stem 20 extending through aperture 88 and fastened by nut 90, and stems 22 and 24 extending through aperture 92 and 94 respectively whereby plate 87 abuts the face of steps 66, 68 and 70 thereby securing frame 54 to backing 12. When the plate is secured in this manner, vertical slots or windows 96 and 98 in plate 87 are vertically aligned with recesses 26 and 28 respectively and lenses 100 and 102 are directly in front of lights 30 and 32, lens 100 being red in colour and lens 102, green. A depiction of a boat 106 is disposed between windows 96 and 98 to represent the boat on which the buoy indicator of this invention is secured. Stand 108 is secured to backing member 12 and is secured through apertures, for example aperture 110 in the base of the stand to the boat by a screw (not shown). The purpose of lenses 100 and 102 is to remind the navigator of the boat that power boats approaching from the right, or the starboard side, have the right of way and those approaching from the left must yield to him.

To use the buoy reminder of this invention, the navigator need only determine whether his craft is travelling upstream or downstream and set the appropriate depictions of the buoys in the windows. Since light is directed through recesses 26 and 28 into channel 18, windows 96 and 98 are illuminated for evening or night use.

It is, of course, readily apparent that if frame 54 is omitted, channel 18 transversely enlarged, indicator 34 elongated still further to extend laterally beyond base 12 and secured in channel 18 for rotation about stem 20, and a pair of buoy depictions 46 and 48 vertically aligned on either side of said indicator such that like-buoy depictions are in the same horizontal plane when the indicator is disposed horizontally, when indicator 34 is rotated clockwise through an angle of less than about 25° within channel 18, a nun and a can buoy will be displayed in windows 96 and 98 respectively and when the indicator is reciprocated to its initial position, a can and nun buoy, respectively.

The components of the buoy reminder may be injection molded of a plastics material, cut and shaped from wood treated to prevent water absorption, or manufactured from any material suitable in such an instrument. It is, of course, to be appreciated that the type of plastics material is irrelevant so long as the necessary rigidity is imparted to the structure. The slide may comprise a plastics material and should preferably be of a light-conducting material.

As many changes may be made in the construction of the invention without departing from the scope thereof, it is intended that all matter contained in the above description and shown in the accompanying drawings shall be interpreted as illustrative only, and not in a limiting sense.

What we claim is:

1. A buoy for determining a navigable channel reminder comprising an indicator having spaced depictions of pairs of nun and can buoys thereon, a mounting member for supporting the indicator for lateral reciprocal movement, a frame secured to the mounting member for rotational movement of the frame, the frame having on its inner surface a first cam and the mounting member having a first recess diametrically opposed the first cam, a second cam adjacent the first recess and the mounting member having a second recess diametrically opposed the second cam and adjacent the first cam, the distance between each cam and its diametrically opposed recess being such to accommodate the indicator, a face cover having two spaced display windows therein to alternately display nun and can buoys and can and nun buoys respectively in the windows when the frame is rotated in one direction, then the reverse direction, causing the cams to alternately move the indicator in one direction then the return direction.

2. The buoy reminder of claim 1, wherein said frame is rotated less than 180° to alternately display the can and nun buoys and nun and can buoys respectively in the windows.

3. The buoy reminder of claim 1, wherein said frame is rotated less than 25° to alternately display the can and nun buoys and nun and can buoys respectively in the windows.

4. A buoy for determining a navigable channel reminder comprising a base having a channel therein adapted to support an indicator thereon for reciprocal movement thereof, said indicator having two pairs of depictions of nun and can buoys thereon in specific relation, adapted for reciprocal movement, in said channel, means to effect lateral reciprocal movement of said indicator comprising a frame secured for rotation about said base, said frame including an arcuate shoulder formation extending radially inwardly from at least a portion of an inner radial surface of said frame, said shoulder formation having two recessed ledges therein coplanar with a backwall of said channel when said frame is secured about said base to accommodate the indicator mounted for reciprocal movement in said channel and means on the inner wall of said frame to engage said indicator and cam it longitudinally in the channel in one direction when the frame is rotated in one direction and cam it longitudinally in the reverse direction in the channel when the frame is rotated in the other direction whereby a nun and can buoy are exhibited at first and second sites respectively when said indicator is in a first position in said channel and a can and nun buoy are exhibited at said first and second sites respectively when said indicator is moved longitudinally to said second position, display means to exhibit the depictions of nun and can buoys at first and second sites respectively when said indicator is in a first position in said channel and exhibit the depictions of can and nun buoys at said first and second sites respectively when said indicator is moved to a second position.

5. The buoy reminder of claim 14, wherein said frame is rotated less than 180° in camming said indicator longitudinally from said first position to said second position.

6. The buoy reminder of claim 4 wherein said frame is rotated less than 25° in camming said indicator from said first position to said second position.

7. A buoy for determining a navigable channel reminder comprising a mounting member, a raised central circular portion contained within the periphery of said mounting member, a longitudinal channel therein adapted to receive an indicator therein for longitudinal reciprocal movement thereof, said indicator having depictions of two pairs of nun and can buoys thereon, a frame secured to seat against said backing for rotation about said circular central portion, said frame having ledges therein in substantially the same plane as a backwall of said channel when said frame is secured to said mounting member to accommodate a portion of said indicator mounted in said channel and cam means on an inner wall of said frame to engage said indicator and cam it longitudinally in the channel in one direction when the frame is rotated in one direction and cam it longitudinally in the reverse direction in the channel when the frame is rotated in the other direction, whereby depictions of nun and can buoys are exhibited at first and second sites respectively when said indicator is in a first position in said channel and depictions of can and nun buoys are exhibited at said first and second sites respectively when said indicator is moved longitudinally to a second position.

8. The buoy reminder of claim 7, wherein said frame is rotated less than 180° in camming said indicator longitudinally from said first position to said second position.

9. The buoy reminder of claim 7, wherein said frame is rotated less than 25° in camming said indicator from said first position to said second position.

* * * * *